US008873715B2

(12) United States Patent
Ogata et al.

(10) Patent No.: US 8,873,715 B2
(45) Date of Patent: Oct. 28, 2014

(54) INDUSTRIAL X-RAY TUBE

(75) Inventors: Kiyoshi Ogata, Minato-ku (JP); Yoshihiro Takeda, Ome (JP); Tetsuo Kani, Yokohama (JP); Makoto Kanbe, Fussa (JP); Naohisa Osaka, Ome (JP); Takahisa Sato, Higashiyamato (JP)

(73) Assignee: Rigaku Corporation, Akishima-Shi, Tokyo (JP)

( * ) Notice: Subject to any disclaimer, the term of this patent is extended or adjusted under 35 U.S.C. 154(b) by 469 days.

(21) Appl. No.: 13/194,355

(22) Filed: Jul. 29, 2011

(65) Prior Publication Data

US 2012/0027177 A1 Feb. 2, 2012

(30) Foreign Application Priority Data

Jul. 30, 2010 (JP) ..... 2010-172709

(51) Int. Cl.

| | |
|---|---|
| ***G21G 4/08*** | (2006.01) |
| ***G21G 4/04*** | (2006.01) |
| ***H01J 35/06*** | (2006.01) |
| ***H01J 35/16*** | (2006.01) |

(52) U.S. Cl.

CPC ..... *H01J 35/16* (2013.01); *H01J 2235/062* (2013.01); *H01J 2235/16* (2013.01); *H01J 35/065* (2013.01)

USPC ..... 378/136; 378/112; 378/119; 378/121

(58) Field of Classification Search

CPC ..... G21G 4/08; G21G 4/04; G21G 4/06; G21G 4/00; H01J 35/06; H01J 35/04; H01J 35/02; H05G 1/32; H05G 1/34

USPC ..... 378/91, 111, 112, 119, 121, 136, 204, 378/210; 250/493.1

See application file for complete search history.

(56) References Cited

U.S. PATENT DOCUMENTS 6,456,691 B2 9/2002 Takahashi et al.

FOREIGN PATENT DOCUMENTS

JP 1-272039 A 10/1989
JP 11-135042 A 5/1999

(Continued)

OTHER PUBLICATIONS

University of Liverpool, Introduction to Crystallography; 3-D Crystallography; The Crystal Axes, (C) 1997-2007, http://www.materials.ac.uk/elearning/matter/Crystallography/3dCrystallography/CrystalAxes.html. p. 1.*

(Continued)

*Primary Examiner* — Anastasia Midkiff

(74) *Attorney, Agent, or Firm* — Buchanan Ingersoll & Rooney PC

(57) ABSTRACT

An industrial X-ray tube formed by accommodating a cathode and anode in a container having an evacuated interior, in which electrons emitted from the cathode are caused to strike the anode and X-rays are emitted from the anode. The cathode is formed from graphite. The graphite is a layered crystal obtained by layering a plurality of carbon hexagonal planes. The graphite is cut based on crystal axes of the carbon hexagonal planes. The resulting cut surface is caused to function as an electron-emitting surface. For example, directions of an a- and b-crystal axis may be set so as to be arbitrary between each of the layers of the carbon hexagonal planes, the graphite may be cut along a surface parallel to the c-axis, and the resulting cut surface may be caused to function as an electron-emitting surface. The graphite may also be cut along a surface orthogonal to the c-axis.

8 Claims, 10 Drawing Sheets

(56) References Cited

FOREIGN PATENT DOCUMENTS

| | | | |
|---|---|---|---|
| JP | 2000-090813 | A | 3/2000 |
| JP | 2000-156148 | A | 6/2000 |
| JP | 2001-250496 | A | 9/2001 |
| JP | 2001-266780 | A | 9/2001 |

OTHER PUBLICATIONS

Yahachi Saito, "Carbon Nanotube Field Emitters", Journal of the Surface Science Society of Japan, 2002, vol. 23, No. 1, pp. 38-43.

* cited by examiner

VOLTAGE(V) - CURRENT(I) CHARACTERISTICS

INDUSTRIAL X-RAY TUBE

BACKGROUND OF THE INVENTION

1. Field of the Invention

The present invention relates to industrial X-ray tubes that are used when performing non-destructive testing for plant piping and similar structures, where electrons emitted from the cathode are caused to strike the anode, and X-rays are radiated from the anode.

2. Description of the Related Art

Conventionally known industrial X-ray tubes of such description include those having a structure in which the cathode is formed from a filament, a current is applied whereby thermal electrons are emitted from the filament, and the thermal electrons are caused to strike the anode, whereby X-rays are emitted from the anode. X-ray tubes of such description present a problem in that they are large and heavy since a filament power supply is required in addition to a high voltage power supply.

Although outside the field of X-ray tubes, electron-emitting elements in which carbon nanotubes emit electrons based on field emission are known in, e.g., the field of displays, i.e., image displaying. An electron-emitting element of such description is disclosed in, e.g., "Carbon Nanotube Field Emitter," authored by Yahachi Saito and published in the Journal of the Surface Science Society of Japan, and JP-A 2000-090813.

Techniques in which carbon nanotubes are used to form an electron-emitting element are also known in the field of x-ray tubes. For example, such a technique is disclosed in the specifications of each of JP-A 2001-250496, JP-A 2001-266780, and U.S. Pat. No. 6,456,691. Field emission is a phenomenon in which electrons are emitted from the surface of a material when a strong electrical potential is applied to the surface of the material. Carbon nanotubes are tube-shaped particles formed from rings comprising six carbons, the particles being needle-shaped; i.e., having an extremely high aspect ratio (i.e., particle length/particle diameter).

Electron-emitting elements, in which graphite particles are used to emit electrons based on field emission, are also known in the field of displays. For example, an electron-emitting element of such description is disclosed in JP-A 2000-090813. Graphite is a layer-structured substance in which a plurality of individual carbon hexagonal planes (planes in which a plurality rings of six carbons are sequentially arranged to form a layer) are layered on each other.

Also known are electron-emitting elements, in which an end surface formed by cutting a graphite block, a carbon rod, a carbon film, or carbon fiber in a direction perpendicular to the direction in which the carbon hexagonal planes are layered. For example, an electron-emitting element of such description is disclosed in JP-A 2000-156148.

Outside the field of X-ray tubes, there are known fluorescent display devices in which the emitter portion of the cathode structure, from which the electrons are emitted (i.e., the electron-emitting portion), are structured from columnar graphite. For example, a configuration of such description is disclosed in JP-A 11-135042. Graphite may be made into a column shape, and a plurality of column shaped graphite structures may be disposed in substantially the same direction with each other, thereby to form carbon nanotube.

However, carbon nanotubes disclosed in Carbon Nanotube Field Emitter, authored by Yahachi Saito and published in the Journal of the Surface Science Society of Japan; JP-A 2000-090813; JP-A 11-135042, JP-A 2001-250496, and JP-A 2001-266780 are structured so as to have an extremely large aspect ratio (i.e., particle length/particle diameter) with a diameter of about 0.4 to 50 nm. Electrical discharge occurs initially in portions, from within a large number of carbon nanotube assemblies, at which the discharge voltage is lower. A large current then flows in localized portions, after which discharge occurs in other portions. A problem is presented in that portions that experience large localized currents degrade rapidly, increasing the likelihood of the electrical current becoming unstable, and shortening the lifespan.

The electron-emitting element disclosed in JP-A 2000-090813, i.e., the electron-emitting element in which graphite is used, is intended for use as a component of an image-displaying apparatus, not in X-ray tubes. Although this electron-emitting element has a large electrical conductivity and a low work function, making it suitable as an electron-emitting electrode, a problem has been presented in that shaping is difficult and the shape during use is not stable.

The electron-emitting element disclosed in JP-A 2000-156148; i.e., the electron-emitting element in which an end surface, formed by cutting a graphite block, a carbon rod, a carbon film, or carbon fiber in a direction perpendicular to the direction in which the carbon hexagonal planes are layered, forms the electron-emitting surface; is intended for use as a component for electron beam-utilizing instruments such as image-displaying devices, and not for X-ray tubes. In this electron-emitting element, the crystal axes of the plurality of layers of carbon hexagonal planes, namely the a-axis, the b-axis, and the c-axis, coincide with each other between each of the layers, as shown in FIG. 2 of the reference. Therefore, a problem has been presented in that the amount of electron emission from the electron-emitting surface is low.

SUMMARY OF THE INVENTION

In order to resolve the above-mentioned problems in conventional devices, an object of the present invention is to provide an industrial X-ray tube that is compact and small, and that emits a large amount of X-rays.

An industrial X-ray tube according to a first aspect of the present invention is an industrial X-ray tube formed by accommodating a cathode and an anode in a container having an evacuated interior, in which electrons emitted from the cathode are caused to strike the anode and X-rays are emitted from the anode;

wherein the cathode is formed from graphite;

the graphite is a layered crystal obtained by layering of a plurality of carbon hexagonal planes;

the graphite is cut based on crystal axes of the carbon hexagonal planes; and the resulting cut surface is caused to function as an electron-emitting surface.

According to the X-ray tube of such description, the cathode is formed from graphite instead of a filament, and a filament power supply is therefore not necessary. It is therefore possible to manufacture an X-ray tube that is compact and light.

Also, generally, an industrial X-ray tube uses a high voltage to emit high-intensity X-rays. Graphite is suitable for a high voltage, and high-intensity electrons can be emitted by impression of a high voltage. Therefore, an industrial X-ray tube in which graphite is used is able to emit high-intensity X-rays while being compact and light.

Conventionally, cathodes have at times been formed using graphite particles in the field of image-displaying devices, and cathodes have at times been formed using columnar graphite in the field of fluorescent display devices. However, the forming of cathodes in industrial X-ray tubes using graphite has not been known. In the present invention, forming a cathode for industrial X-ray tubes using graphite makes it possible to obtain an industrial X-ray tube that is compact and light and that can emit high-intensity X-rays.

Also, conventionally, electron-emitting elements have been formed using graphite in the field of image-displaying devices and similar fields. However, according to this conventional technique, no particular considerations have been made with regards to the crystal axis of graphite. In contrast, in the present invention, the crystal axis of graphite is taken into consideration in specifying the electron-emitting surface, and it is therefore possible to obtain a cathode that is suitable as a cathode of an industrial X-ray tube.

For example, in relation to graphite in which layers have been grown in the direction of the c-crystal axis, setting the a-crystal axis and the b-crystal axis within each of the layers of the carbon hexagonal plane so as to be disposed in a random direction between each of the layers generates an appropriate variation in the crystal structure present on the electron-emitting surface when the layers are cut and the electron-emitting surface is formed. As a result, the amount of electrons emitted from the electron-emitting surface can be increased.

Also, for example, it is possible to cut, along a plane orthogonal to the c-crystal axis, graphite in which layers have been grown in the direction of the c-axis; polish the resulting cut surface so that the surface roughness is about 0.5 μm (rms); and cause the polished surface to function as the electron-emitting surface. When expressed in terms of a scale at the atomic level, this surface is an assembly of clusters comprising carbon hexagonal planes, wherein each of the clusters are arranged so as to be rotated about the c-axis in a randomly angled manner. Compared to an instance in which graphite is cut along a plane parallel to the c-axis, an arrangement of such description results in a lower electron emission efficiency, but has an effect of increasing resistance against degradation and increasing the lifespan.

The following can be postulated as a reason for the above. Generally, in an X-ray tube, the anode is subjected to electrons emitted from the cathode, whereby X-rays are emitted. In such an instance, recoil electrons or ions are emitted from the anode. Recoil electrons are electrons that are bounced back by a target when the electrons collide with the target. Ions are produced by metal on the surface of a target being ionized and ejected when electrons collide with the target. Also, even though the interior of a tube is regarded to have been evacuated, impurities remain present in the tube, and such impurities may become ionized upon colliding with an electron. The ions mentioned above also contain ions of such description.

It is known that when recoil electrons or ions travel back to the cathode and collide with the surface of the cathode, they damage the cathode material and degrade the characteristics of the cathode. In this respect, by causing the electron-emitting surface to be disposed in a direction orthogonal to the c-axis, i.e., the direction parallel to the hexagonal plane, and causing the electron-emitting surface to face the anode, it is possible to cause the recoil electrons or the ions to collide with the hexagonal plane, which is relatively stable. It is thereby possible to minimize degradation of the cathode material.

In an instance in which a filament is used, it is necessary to connect a power supply cable having a large thickness and high rigidity to an X-ray-emitting unit, adversely affecting portability (i.e., ease of transportation) and self-transportability (i.e., ability to travel by itself within a pipeline). In contrast, according to the industrial X-ray tube of the present invention, it is possible to obtain both high portability and high self-transportability.

Generally, voltages used for medical applications are relatively low, at around 40 to 125 kV. In contrast, voltages used for industrial applications are high, at around 200 to 300 kV. The industrial X-ray tube according to the present invention, in which the cathode is formed from graphite, is suitable for high voltages. The X-ray tube can emit high-intensity X-ray by being operated at a high voltage. In other words, the X-ray tube in which graphite is used according to the present invention is suitable for industrial applications.

An industrial X-ray tube according to a second aspect of the present invention is an industrial X-ray tube formed by accommodating a cathode and an anode in a container having an evacuated interior, in which electrons emitted from the cathode are caused to strike the anode and X-rays are emitted from the anode;

wherein the cathode is formed from graphite;

the graphite is a layered crystal obtained by layering of a plurality of carbon hexagonal planes;

a direction in which the graphite layer is grown is a c-crystal axis direction;

directions of an a-crystal axis and a b-crystal axis are arbitrary directions between each of the layers of the carbon hexagonal planes;

the graphite is cut along a plane parallel to the c-axis; and the resulting cut surface is caused to function as an electron-emitting surface.

According to the X-ray tube of such description, the graphite in which layers have been grown in the direction of the c-crystal axis, and the a-crystal axis and the b-crystal axis within each of the layers of the carbon hexagonal plane are disposed in a random direction between each of the layers. Therefore, an appropriate variation is generated in the crystal structure present on the electron-emitting surface when these layers are cut and the electron-emitting surface is formed. As a result, the amount of electrons emitted from the electron-emitting surface can be increased.

An industrial X-ray tube according to a third aspect of the present invention is an industrial X-ray tube formed by accommodating a cathode and an anode in a container having an evacuated interior, in which electrons emitted from the cathode are caused to strike the anode and X-rays are emitted from the anode;

wherein the cathode is formed from graphite;

the graphite is a layered crystal obtained by layering of a plurality of carbon hexagonal planes;

a direction in which the graphite layer is grown is a c-crystal axis direction;

directions of an a-crystal axis and a b-crystal axis are arbitrary directions between each of the layers of the carbon hexagonal planes;

the graphite is cut along a plane orthogonal to the c-axis; and the resulting cut surface is caused to function as an electron-emitting surface.

According to the X-ray tube of such description, recoil electrons and ions from the anode can be caused to collide with a carbon hexagonal plane that is relatively stable. As a result, degradation of the cathode material can be minimized, making it possible to provide an industrial X-ray tube that is resistant to degradation and has a long lifespan.

In the industrial X-ray tube according to the present invention, the shape of the cathode may be (1) needle-shaped with a diameter of 0.5 to 1.0 mm, (2) linear with a width of 0.5 to 1.0 mm and a length of 5.0 to 20 mm, or shaped as a (3)

filled-in or (4) hollowed-out cylinder with a diameter of 1.0 to 20 mm. The shape used is selected as appropriate according to the cross-section profile of the required X-ray beam.

The industrial X-ray tube according to the present invention may have a heater that heats the cathode to 1000° C. or above. Thus heating the heater makes it possible to remove the surface of the cathode whose performance has decreased due to contamination or degradation, expose a clean surface, and increase the lifespan of X-ray diffraction. The heater may also have a configuration in which an electrical current is passed through the cathode to heat the cathode.

In the field of electron microscopes, there exists a known technique called a flashing process, in which a current is applied to an electron gun that performs electrical field discharge, in order to remove contamination on the surface of the electron gun and to correct the shape of the electron gun. This flashing process is disclosed, for example, in JP-A 1-272039. Although this flashing process changes the overall shape of the electron gun, the heating process according to the present invention does not change the shape of the entire cathode, and instead corrects the shape of individual carbon hexagonal planes (i.e., graphene sheets).

The industrial X-ray tube according to the present invention may have voltage control means that controls a voltage applied between the cathode and the anode; wherein the voltage control means is capable of recording the voltage-current characteristics between the cathode and the anode, and is capable of applying a voltage between the cathode and the anode according to the voltage-current characteristics. This configuration makes it possible to apply an optimal voltage, even in an instance in which repeated X-ray measurements cause a change in the length of the cathode.

Figure 4:
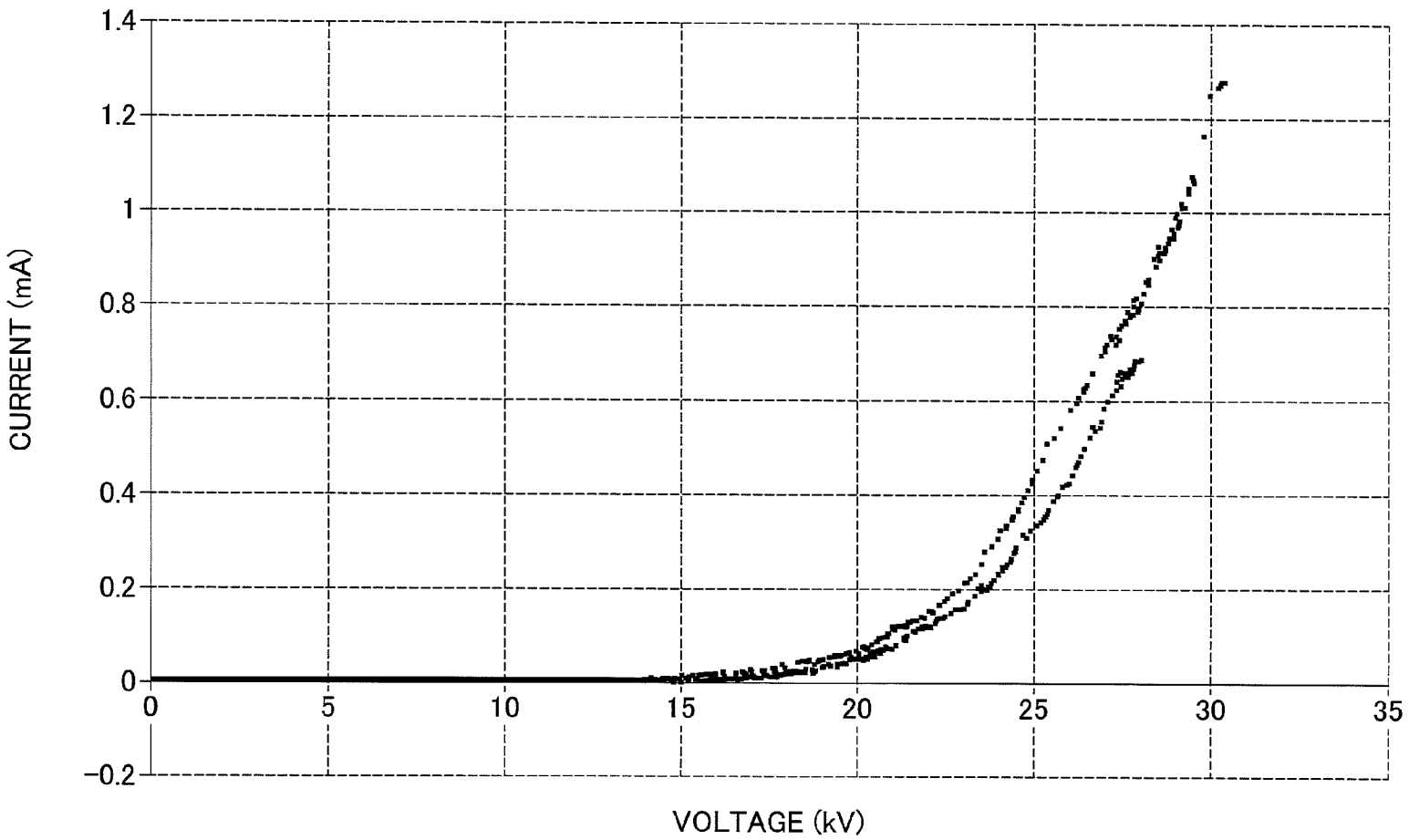
Figure 5A:
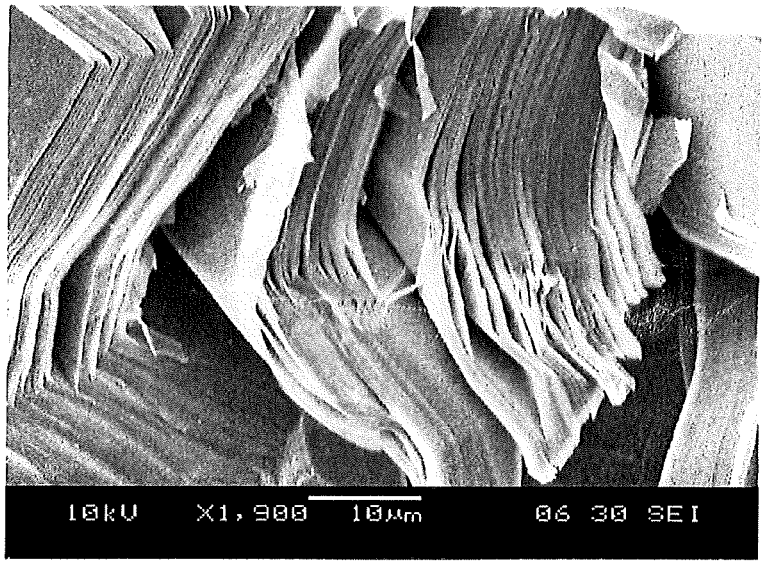
Figure 5B:
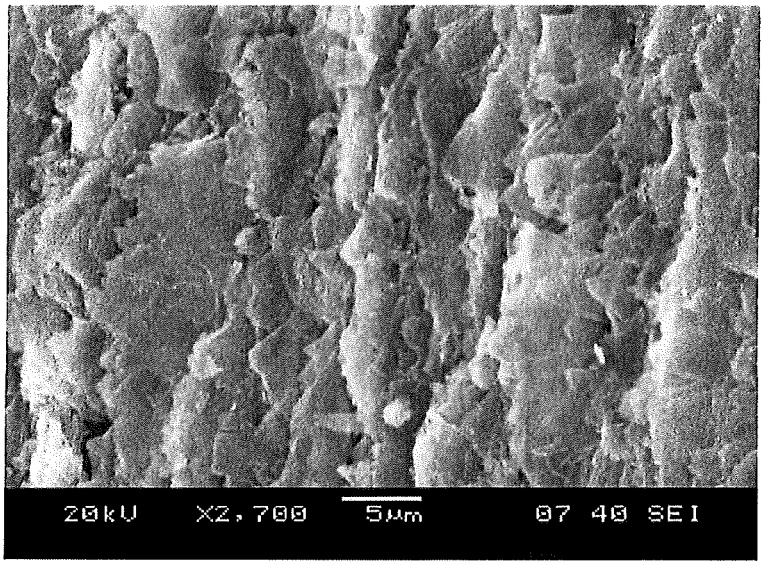
Figure 6A:
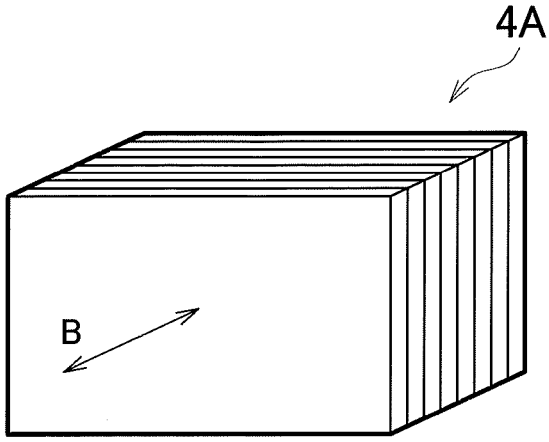
Figure 6B:
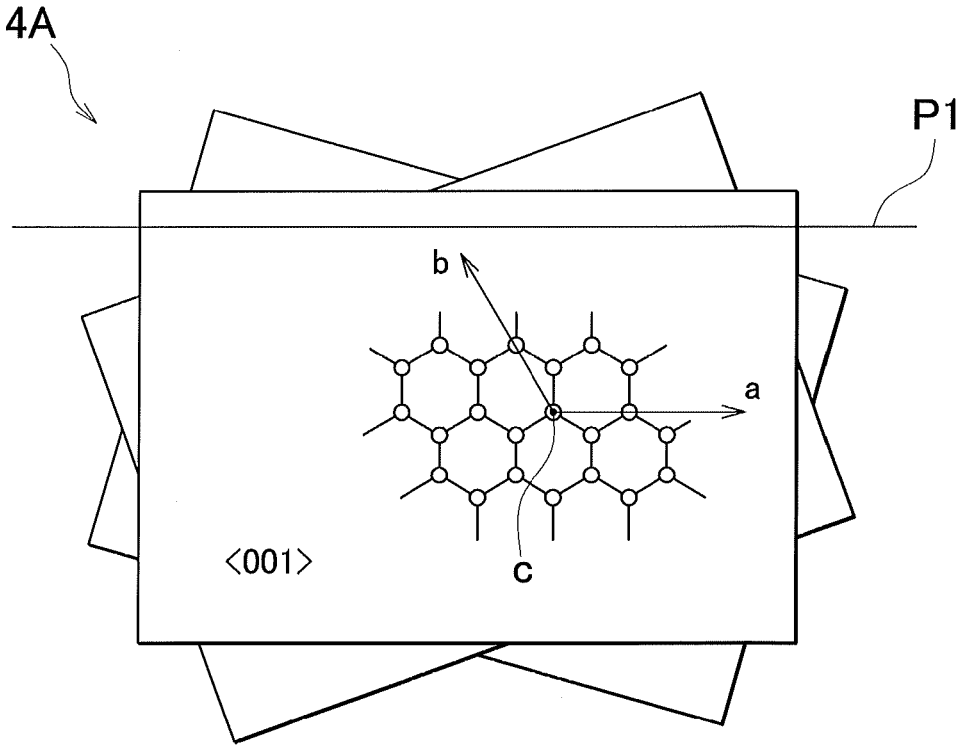
Figure 7:
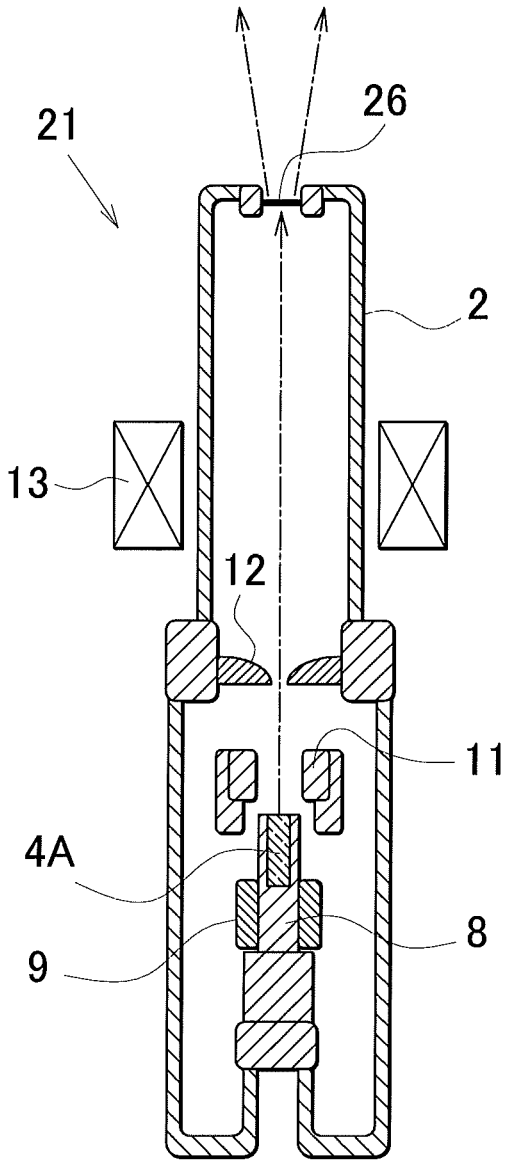
Figure 8:
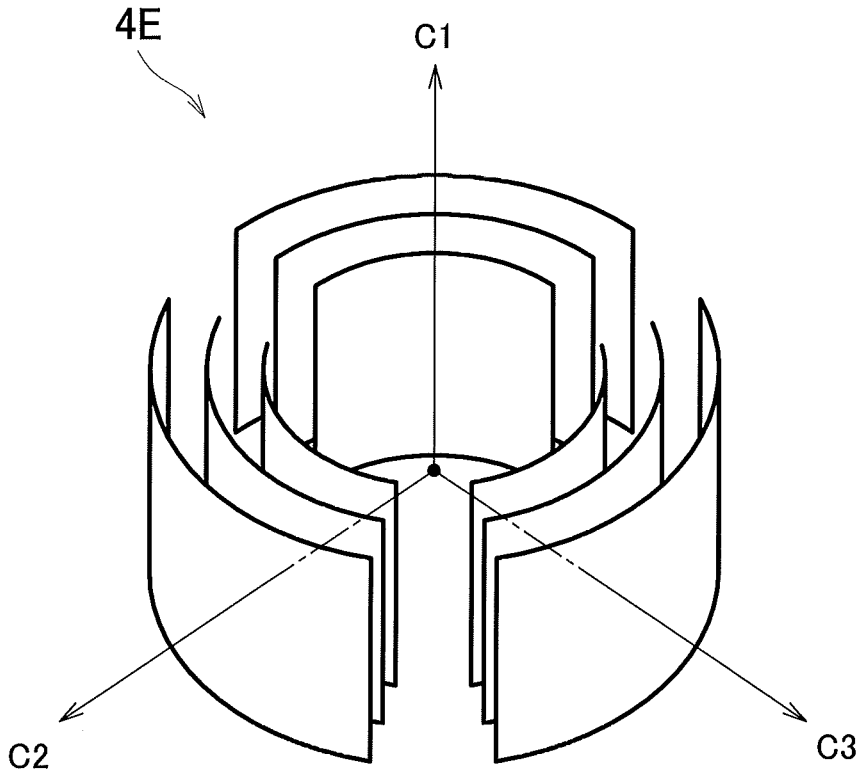
Figure 9:
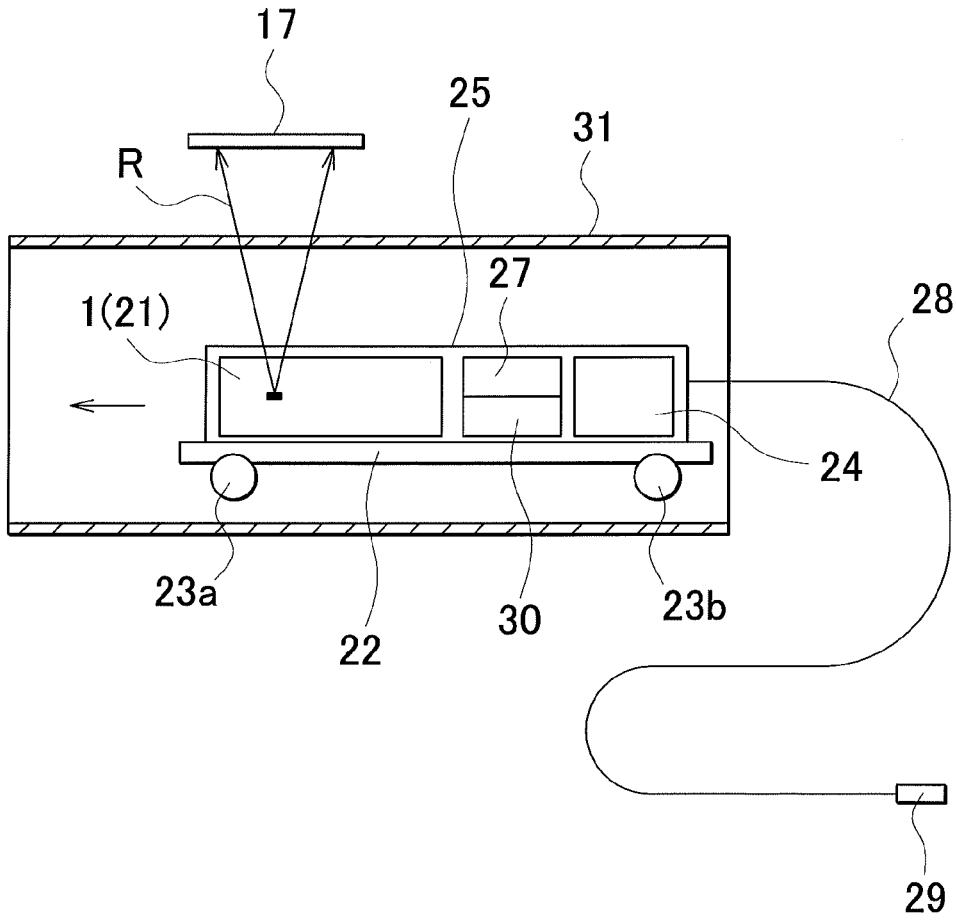
Figure 10:
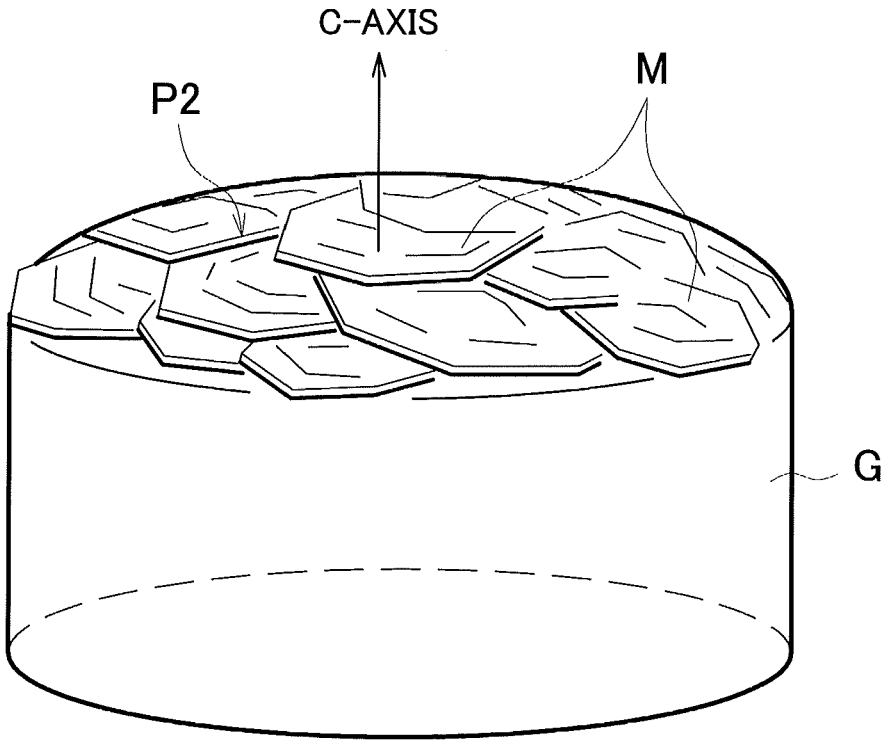

Each of FIGS. 3A, 3B, 3C, and 3D is a drawing showing an example of modification of the cathode;

FIG. 4 is a graph showing the voltage-current characteristics between the cathode and the anode;

Each of FIGS. 5A and 5B is a drawing showing an electron microscope image of graphite, which is a constituent of the cathode;

FIG. 6(A) is a schematic diagram showing the process by which layers are grown in graphite as viewed from the side, and FIG. 6(B) is a schematic diagram showing the process by which layers are grown in graphite as viewed from above;

FIG. 7 is a cross-sectional view of another embodiment of the industrial X-ray tube according to the present invention;

FIG. 8 is a perspective view showing an example of modification of the cathode;

FIG. 9 is a cross-sectional view of another embodiment of the industrial X-ray tube according to the present invention; and FIG. 10 is a schematic perspective view of an example of graphite used in another embodiment of the industrial X-ray tube according to the present invention.

DESCRIPTION OF THE PREFERRED EMBODIMENTS

The industrial X-ray tube according to the present invention will now be described with reference to embodiments. It shall be apparent that these embodiments are not intended to limit the scope of the present invention. While references will be made to the accompanying drawings in the description given hereinafter, the drawings may show constituent elements in a scale that is different from reality so that characteristic portions can be shown in a readily comprehensible manner.

First Embodiment

Figure 1:
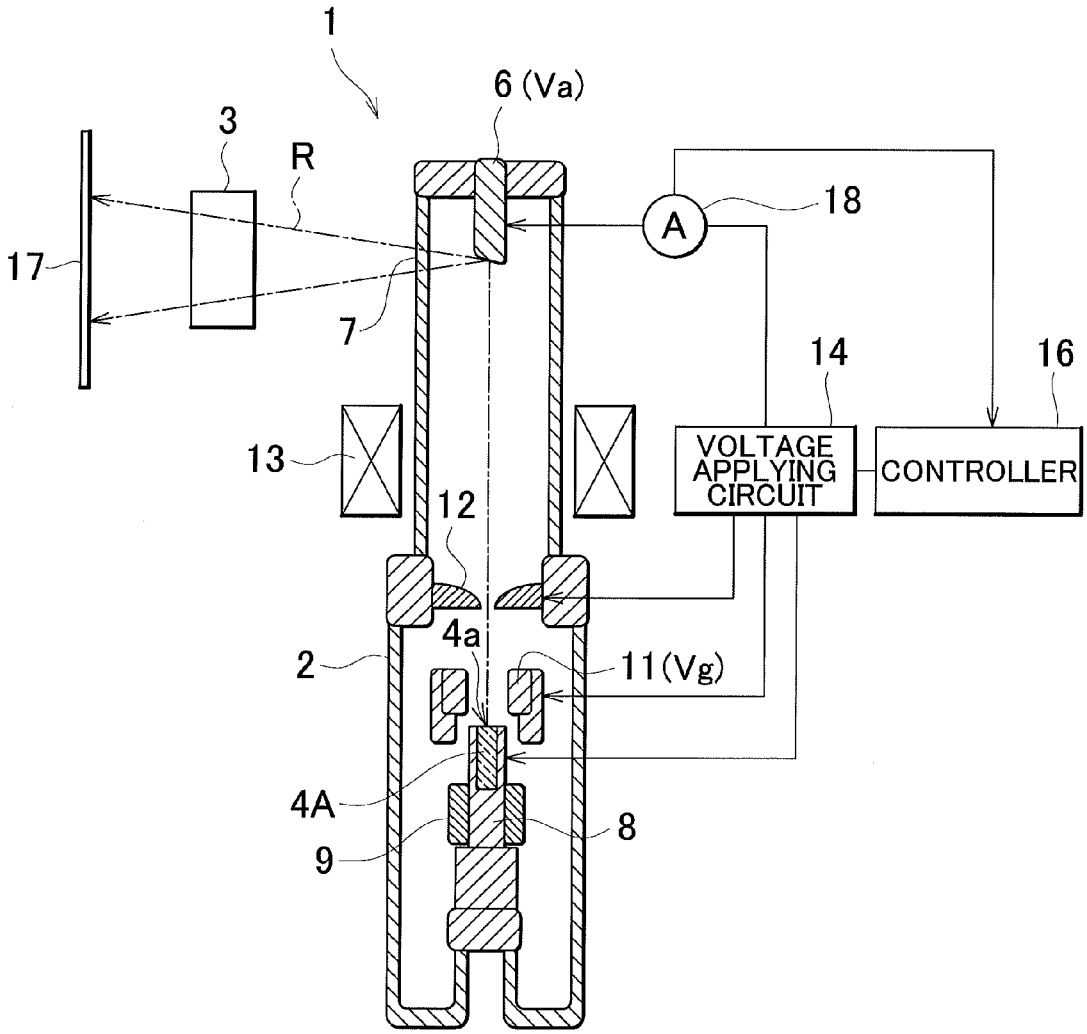
FIG. 1 is a cross-sectional view of an embodiment of an industrial X-ray tube according to the present invention.

FIG. 1 shows a cross-sectional view of an embodiment of the industrial X-ray tube according to the present invention. The X-ray tube 1 according to the present embodiment has a sealing container 2 made from a ceramic (for example, alumina ($Al_2O_3$)) or glass. The sealing container 2 is shaped as a hollowed-out cylinder, and the interior thereof is maintained in a vacuum state. The sealing container 2 is electrically insulated by solid molding, immersion in an insulating oil, sealing-in of a high-pressure insulating gas, or a similar method; and then accommodated in a portable-type container. The sealing container 2 is carried by the measuring technician to a object 3 to be measured such as, for example, a frame of a construction structure.

A cathode 4A is provided towards one end (the lower-end side in FIG. 1) of the interior of the sealing container 2, and an anode 6 is provided towards another end (the upper-end side in FIG. 1). It is known that structures exposed to a high voltage generally emit creeping discharge from the air-insulator-metal triple point. In the present embodiment, in order to prevent this creeping discharge, end parts of a ceramic sealing container 2 are indented, and the cathode 4A and/or the anode 6 are provided in the ceramic sealing container.

In the X-ray tube according to the present embodiment, a high voltage of, for example, 200 kV is applied between the cathode 4A and the anode 6; X-ray having a maximum energy of 200 keV is emitted from the anode 6; and an X-ray transmission image of an iron pipe having a thickness of 50 mm or greater is captured. High-energy X-ray of such description is readily transmitted through the ceramic container. Therefore, in this embodiment, the sealing container 2 is not provided with a special X-ray window for passing X-rays through to the exterior of the sealing container 2.

However, in an instance in which a low energy region of 20 keV or less, such as for transmission image-capturing of food or a similar material, a window for transmitting X-rays is provided, using, for example, beryllium (Be), for example at the portion near the anode 6 and indicated by the numeral 7.

Figure 2:
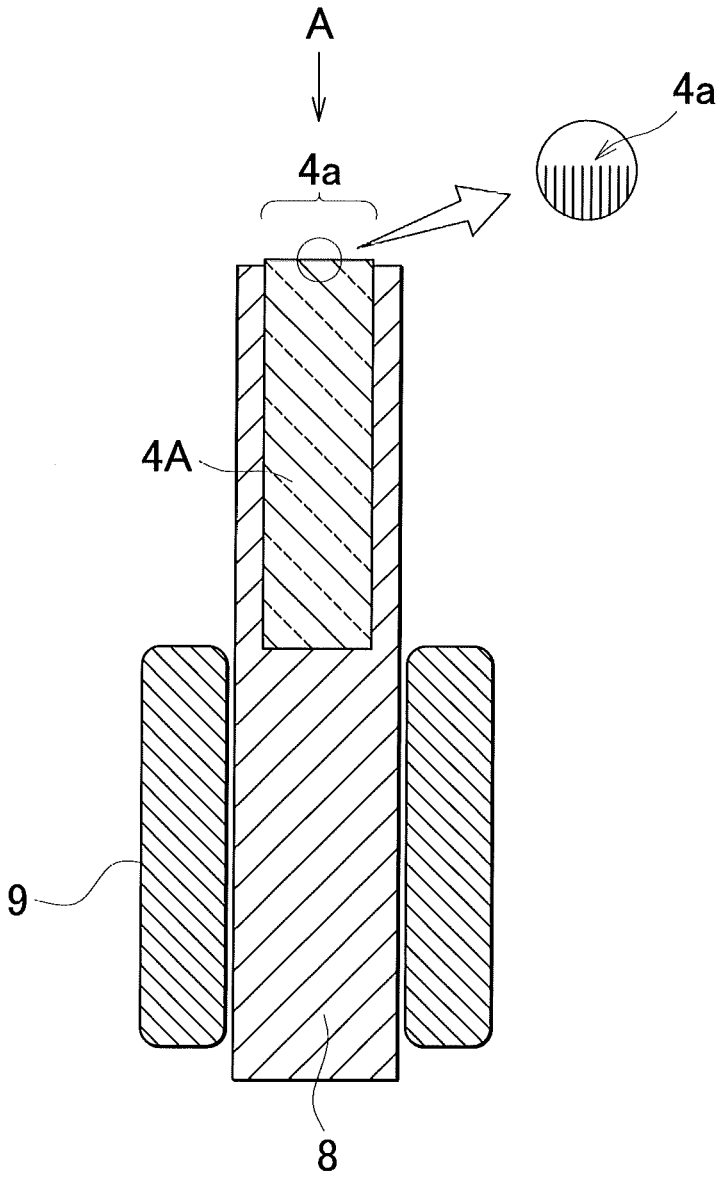
FIG. 2 is a cross-sectional view showing the configuration of the cathode, which is a principle part of the X-ray tube shown in FIG. 1, and the surroundings thereof.

As shown in FIG. 2, the cathode 4A is supported by a supporting frame 8 having electrical and thermal conductivity. The supporting frame 8 is formed from, for example, stainless steel. A heater 9 is provided as heating means surrounding the supporting frame 8.

Figure 3A:
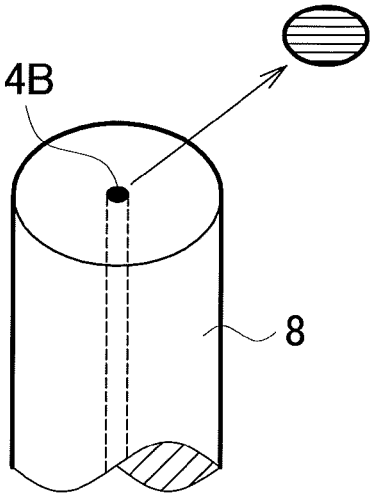
Figure 3B:
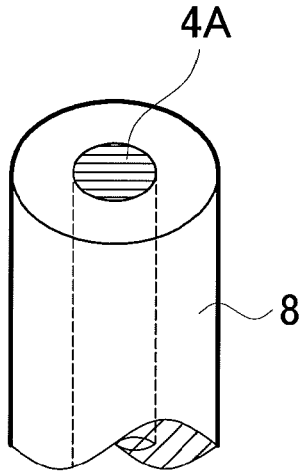

The supporting frame 8 is formed as a hollowed-out cylinder as shown, for example, in FIG. 3B. The cathode 4A is accommodated in a concave space having a circular cross section provided to the distal end of the supporting frame 8; and is formed as a filled-in cylinder. The cathode 4A has a length of, for example, 100 μm, and an appropriate diameter within a range f, for example, 1.0 to 20 mm. A cathode 4A shaped as a filled-in cylinder having the dimensions described above is suitable for an instance in which a large electrical current is to be passed therethrough.

The cathode 4A is formed from graphite, which is a substance formed by layering a plurality of layers comprising a carbon hexagonal plane (i.e., graphene) as described further below in more detail. An end surface 4*a*, formed by cutting the carbon hexagonal planes in a direction parallel to the direction of layering (see FIG. 2), functions as an electron-emitting surface.

An extraction electrode (i.e., a grid) 11, an electrostatic lens 12, and a magnetic lens 13 are provided in the stated order from the cathode 4A, along the progress route of electrons from the cathode 4A to the anode 6, in FIG. 1. The extraction electrode 11 and the electrostatic lens 12 are provided in the interior of the sealing container 2, and the magnetic lens 13 is provided in the exterior of the sealing container 2.

A voltage-applying circuit 14 controls a voltage Vg of the extraction electrode 11 with respect to the cathode 4A according to a command from a controller 16, and as a result, controls the voltage Va of the anode 6 with respect to the cathode 4A. The voltage-applying circuit 14 also applies a predetermined voltage on the electrostatic lens 12. The magnetic lens 13 consists of permanent magnets in the present embodiment. The magnetic lens 13 may also be made of electromagnets. The voltage-applying circuit 14 and the controller 16 work together and constitute voltage-controlling means that controls the voltage between the cathode and the anode.

When the extraction voltage Vg is applied on the extraction electrode 11, electrons are emitted from the electron-emitting surface 4*a* of the cathode 4A based on field emission. These electrons are caused to accelerate by the voltage Va between the cathode 4A and the anode 6, and collide with the anode 6. X-rays R are emitted at the site of collision, and extracted to the exterior through an X-ray window 7. The X-rays R are directed on the object 3 to be measured, and a two-dimensional X-ray detector 17 is exposed to X-ray that has been transmitted through the object 3 to be measured. This X-ray exposure forms an X-ray image on a light-receiving surface of the two-dimensional X-ray detector 17. By observing this X-ray image, it is possible to inspect the characteristics of the object 3 to be measured, such as whether or not the object 3 to be measured is damaged or faulty.

The two-dimensional X-ray detector is configured from, for example, an X-ray film, an imaging plate, a charge-coupled device (CCD), a semiconductor pixel detector, or another component. Each of the electrostatic lens 12 and the magnetic lens 13 corrects the trajectory of the electrons in an appropriate manner.

An ammeter 18 is provided on the circuit linking the cathode 4A and the anode 6. The ammeter 18 is configured from, for example, a resistor and a voltage-measuring circuit. A signal outputted from the ammeter 18 is transmitted to the controller 16. The controller 16 is configured so as to include a microprocessor and a memory device. A region for storing the voltage-current characteristics shown in FIG. 4, which is a graph showing the relationship between the anode voltage Va and a current I flowing through the anode, is set in the memory device.

The controller 16 measures the voltage-current characteristics according to one or a plurality of desired timings during which measurement is performed, and records the characteristics data in the predetermined storage region in the memory device. If X-ray measurement is performed in a continual manner, discharge characteristics of the cathode 4A may change over time. If the discharge characteristics of the cathode 4A change over time, the size of the current flowing through the anode 6 may change; however, the controller 16 is able to select an ideal voltage according to the voltage-current characteristics.

One possible cause of a change in discharge characteristics of the cathode 4A over time is a change in the shape of graphite forming the cathode 4A. Another possible cause is a gradual change in the degree of cathode surface contamination or the cathode length due to repeatedly using the X-ray tube; repeatedly performing the flashing process, which is a process for cleaning the cathode; or other reasons.

FIG. 5 is a photograph of the electron-emitting surface 4*a* of the cathode 4A shown in FIG. 2, taken using a scanning electron microscope from the direction shown by the arrow A, i.e., a scanning electron microscope image. As can be seen from FIG. 5A, a plurality of graphene sheets, i.e., carbon hexagonal planes, are arranged in a direction parallel to the direction of electron emission (in FIG. 5A, the direction perpendicular to the paper sheet, i.e., the direction that passes through the plane of the drawing). FIG. 5B shows the electron-emitting surface 4*a* after cutting, and shows a state in which the distal-end portion is inclined in a diagonal direction. In this instance, again, it can be seen that a plurality of carbon hexagonal planes are arranged parallel to the direction of electron emission (in FIG. 5B, the direction perpendicular to the paper sheet).

The cathode 4A of the present embodiment, i.e., graphite, is a layered crystal as shown schematically in FIG. 6A, and the direction B of layer growth is the c-crystal axis direction. Specifically, the direction of the c-axis of each of the carbon hexagonal plane layers is identical. Meanwhile, the a-axis and the b-axis, which are axes within each of the carbon hexagonal plane layers that are layered on each other, are aligned in a randomly angled (i.e., unstructured) manner with respect to each other within the (001) plane in each of the layers, as shown schematically in FIG. 6B.

The carbon hexagonal planes, which are layered in a state in which the crystal axes are randomly oriented, are cut along a plane P1 that is parallel to the direction of the c-axis (i.e., direction in which the carbon hexagonal planes are layered; direction that passes through the plane of the drawing in FIG. 6B); and the resulting cut surface is used as an electron-emitting surface. Thus, the a-axis and the b-axis of the carbon hexagonal planes forming graphite, which is the cathode 4A, are aligned in a randomly angled manner with respect to each other between each of the layers, thereby making it possible to emit a large amount of electrons in an efficient manner from the electron-emitting surface obtained by cutting the carbon hexagonal planes.

Looking at graphite on an atomic level, graphite is a layered structure formed from carbon hexagonal planes (i.e., graphene sheets) having a thickness of several tens to several hundred nanometers. Within the plane of the sheet, the electrical conduction by n-electrons results in a low electrical resistance and work function, making graphite ideal as an electron emitter.

As for a method of manufacturing the cathode 4A, i.e., graphite, a possible method is one in which a graphite precursor such as Teflon™ is molded at, e.g., 1100° C.; heated in a vacuum and crystallized; subjected to vacuum annealing for an hour or more at 400° C. to 600° C. after molding; and degassed. Crystallization is performed so that the a-crystal axis and the b-crystal axis of each of the layers are randomly oriented with respect to each other.

Alternatively, single-crystal graphite may be cut and graphite manufactured. In such an instance, subjecting the end surface to a mechanical force may break the carbon hexagonal plane. Therefore, argon (Ar) ion etching, oxygen plasma, or another technique may be used to adjust the shape of the surface. After molding, vacuum annealing is performed for an hour or more at 400° C. to 600° C. and degassing is performed. Manufacturing of graphite is performed so that the a-crystal axis and the b-crystal axis of each of the carbon hexagonal plane layers are randomly oriented with respect to each other.

When X-ray measurement is performed repeatedly, cathode material gradually sublimes from the electron-emitting surface 4*a*, which is the end surface of the cathode 4A. Contamination by impurities, damages from collision of metal ions from the anode 6, and other factors cause the characteristics of the surface of the cathode 4A to degrade. In an instance in which it is judged that characteristics degradation has occurred, the controller 16 applies a current through the heater 9 at an appropriate timing at which X-ray measurement is not being performed, causes the heater 9 to generate heat, and heats the cathode 4A to, for example, 1000° C. or more. This heat causes the surface of the cathode 4A to sublime in vacuum; the surface that has degraded is removed, and the surface of the cathode 4A is cleaned. This cleaning prevents degradation of field emission characteristics of the cathode and makes it possible to increase the lifespan. This cleaning process is sometimes referred to as a flashing process, and is performed a plurality of number of times at appropriate times as necessary.

The cathode 4A may also be heated by passing an electrical current through the cathode 4A itself, i.e., the graphite itself, instead of using the heater 9 to heat the cathode 4A.

Second Embodiment

FIG. 7 is a cross-sectional view of another embodiment of the industrial X-ray tube according to the present invention. In FIG. 7, constituent elements that are identical to the constituent elements shown in FIG. 1 are affixed with identical numerals, and a description thereof shall not be provided.

In the X-ray tube 1 shown in FIG. 1, electrons released from the cathode 4A are caused to collide with the anode 6, and X-rays are emitted towards the sideway or the front of the anode 6. In contrast, in an X-ray tube 21 shown in FIG. 7, a transmission-type target is used as an anode 26. When electrons emitted by the cathode 4A collide with the anode 26, X-rays are emitted towards the rear of the anode 26.

An example of the transmission-type target is a sheet formed by layering tungsten (W) and beryllium (Be). If W is arranged on the inside of the X-ray tube, the accelerated electrons collide with the W sheet, and emit white X-rays and fluorescent X-rays which are transmitted through the Be sheet. The decelerated electrons pass through the electrically conductive target and are recovered by the power supply. The thickness of the W and the Be sheets are set to optimal values based on X-ray absorption, calculated according to the X-ray energy drawn from the X-ray tube.

Third Embodiment

FIG. 9 shows another embodiment of the industrial X-ray tube according to the present invention. The X-ray tube according to this embodiment is the X-ray tube 1 shown in FIG. 1. It shall be apparent that the X-ray tube 1 may instead be the X-ray tube 21 shown in FIG. 7 or another X-ray tube having a similar structure.

The X-ray tube 1 is electrically insulated by solid molding, immersion in an insulating oil, sealing-in of a high-pressure insulating gas, or a similar method; and then accommodated in a portable-type container 25, along with a battery 24, a power supply circuit 30, and an electricity control system 27. The container 25 is secured on a wheeled platform 22. The wheeled platform 22 has wheels 23*a*, 23*b*. At least one of the wheels 23*a*, 23*b* is a driven wheel that is driven by a power source. A driving system including the power source is not shown. The wheels 23*a*, 23*b* may also be provided directly on the container 25, instead of the container 25 being placed on the wheeled platform 22. The electricity control system 27 includes, for example, the voltage-applying circuit 14 and the controller 16 shown in FIG. 1.

A communication cable 28 extends from the electricity control system 27 to the exterior of the container 25. An operation input unit 29 is connected to a distal end of the communication cable 28. The operation input unit 29 comprises a variety of switches such as a button switch and an input amount adjustment switch, and is operated by the measuring technician. The communication cable 28 is a light line material that is flexible and ductile, and readily follows the movement of the wheeled platform 22.

The wheeled platform 22 is arranged in a pipe 31, which is the object to be measured, in a state in which the X-ray tube 1, the battery 24, the power supply circuit 30, and the electricity control system 27 are placed on top. The pipe 31 is, for example, a pipework in a plant. The wheeled platform 22 is caused to travel within the pipe 31 and arranged at a desired position of measurement by the measuring technician operating the operation input unit 29. When the wheeled platform 22, and therefore the X-ray tube 1, are arranged at the predetermined position, X-rays R are emitted from the X-ray tube 1 according to an instruction issued by the measuring technician, and an X-ray image of the pipe 31 is formed on the X-ray detector 17 installed outside the pipe 31.

In a conventional industrial X-ray tube, a filament is used as the cathode; a current is applied whereby the filament is heated, thermal electrons are emitted by the filament, and X-rays are obtained from the thermal electrons. In this instance, it is necessary to apply a high voltage to the filament and supply a large current. A thick and highly rigid power supply cable is required in order to supply a high voltage and a large current. Therefore, it is difficult to allow a conventional industrial X-ray tube to travel within the pipe to be measured and to perform measurement. In particular, measurement is extremely difficult in an instance in which the pipe is not linear.

In the industrial X-ray tube 1 according to the present embodiment, the cathode is formed from graphite, and electrons are emitted based on field emission. Therefore, there is no need to supply a large current as necessary in an instance in which a filament is used. Therefore, the battery 24 used in the present embodiment is compact, and a thick and highly rigid power supply cable is not necessary. The only necessary linear member that extends to the exterior of the container 25 is a thin and ductile communication cable for transmitting electrical signals. Therefore, the wheeled platform 22 carrying the X-ray tube 1 and the compact battery 24 is able to freely travel within the pipe 31 without being subjected to a large load, and the X-ray tube 1 is able to perform X-ray measurement without hindrance.

A wireless LAN, instead of the communication cable 28, may be used [for communication] between the electricity control system 27 and the operation input unit 29. Thus, the wheeled platform 22 is able to travel within the pipe 31 in an even less restricted manner. Also, an X-ray tube 1 that is self-transportable can be readily used to perform measurement on piping located at inaccessible locations such as high places that cannot be accessed by personnel or areas where the piping arrangement is highly dense and complex.

The X-ray tube 1 according to the present embodiment, which uses graphite, in which the crystal axes are randomly oriented with respect to each other between each of the graphene layers, has extremely low power consumption.

Therefore, [the X-ray tube 1] is, for example, capable of carrying an 80 Wh lithium ion battery and driving a 50 W X-ray tube for an hour or more.

Fourth Embodiment

In the embodiments described above, graphite in which layers have been grown in the direction of the c-crystal axis is cut along a plane P1 that is parallel to the c-axis. In contrast, in the present embodiment, graphite G in which layers have been grown in the direction of the c-crystal axis is cut along a plane P2 that is orthogonal to the c-axis, as shown in FIG. 10. Also, in the present embodiment, the cut plane P2 is polished so that the surface roughness is about 0.5 μm (rms), and the resulting polished surface is caused to function as the electron-emitting surface.

When expressed in terms of a scale at the atomic level, this surface is an assembly of clusters comprising carbon hexagonal planes M, wherein each of the clusters are arranged so as to be rotated about the c-axis in a randomly angled manner. An arrangement of such description results in a lower cathode electron emission efficiency compared to an instance in which cutting is performed along a plane parallel to the c-axis, but makes it possible to provide a cathode that has increased resistance against degradation and a longer lifespan.

The following can be postulated as one of the reasons why the lifespan can be thus increased.

Specifically, in a regular X-ray tube, electrons emitted from the cathode are directed at the anode, whereby X-rays are emitted. It is known that in such an instance, recoil electrons or ions are emitted from the anode, and the recoil electrons travel back to the cathode and collide with the surface of the cathode, thereby damaging the cathode material and degrading the characteristics of the cathode. By causing the electron-emitting surface to be disposed in a direction orthogonal to the c-axis, i.e., the direction parallel to the hexagonal plane, and causing the electron-emitting surface to face the anode, as in the present embodiment, it is possible to cause the recoil electrons or the ions to collide with the hexagonal plane, which is relatively stable. It is thereby possible to minimize degradation of the cathode material.

Other Embodiments

Although the present invention has been described above with reference to preferable embodiments, the invention is not limited in scope to the embodiments, and can be modified in a variety of manner within the scope of the invention described in the claims.

For example, in the above embodiments, the cathode 4A is configured so as to have a filled-in cylindrical shape as shown in FIG. 3B. However, the cathode may be a cathode 4B having a needle shape with a diameter of 0.5 to 1.0 mm, as shown in FIG. 3A. This cathode 4B is suitable for forming a micro-focused X-ray beam.

Figure 3C:
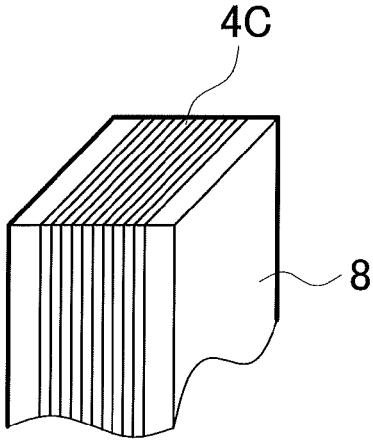
Figure 3D:
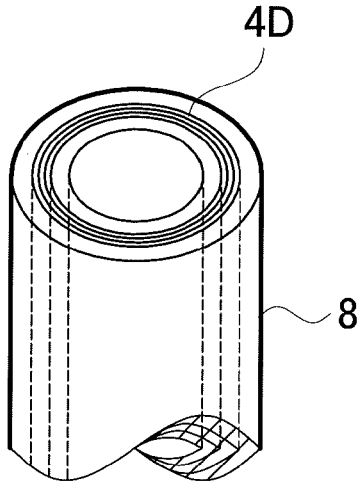

The cathode may be a cathode 4C having a linear shape with a width of 0.5 to 1.0 mm and a length of 5.0 to 20 mm, as shown in FIG. 3C. The cathode 4C is suitable for forming a line-focused X-ray beam. The cathode may also be a cathode 4D shaped as a hollowed-out cylinder, as shown in FIG. 3D. The cathode 4D is suitable for use on a transmission-type target.

In the embodiments described above, as shown in FIG. 6A, the crystal layers are grown in one direction shown by the arrow B, whereby substantially plate-shaped graphite is formed. However, the direction in which the crystal layers are grown is not limited to one direction; a plurality of directions is also possible. For example, as shown in FIG. 8, it is possible to grow the crystal layers in three directions, namely C1 through C3, that extend in a radial configuration, to form so-called petal-shaped graphite, and to use the resulting graphite as a cathode 4E.

In the embodiments described above, the graphite is cut in a direction parallel to or orthogonal to the c-axis of the crystal, and the cut surface is caused to function as the electron-emitting surface. However, the direction in which the graphite is cut is not limited to a direction parallel to or orthogonal to the c-axis, and a desired direction that is diagonal with respect to the c-axis is also possible.

What is claimed is:

1. An industrial X-ray tube formed by accommodating a cathode and an anode in a container having an evacuated interior, in which electrons emitted from the cathode are caused to strike the anode and X-rays are emitted from the anode;

wherein said cathode is formed from graphite;

the graphite is a layered crystal obtained by layering of a plurality of carbon hexagonal planes;

a direction in which the graphite layer is grown is a c-crystal axis direction;

directions of an a-crystal axis and a b-crystal axis are arbitrary directions between each of the layers of the carbon hexagonal planes;

said graphite is cut along a plane parallel to the c-axis; and the resulting cut surface is caused to function as an electron-emitting surface.

2. The industrial X-ray tube according to claim 1, wherein the shape of said cathode is needle-shaped with a diameter of 0.5 to 1.0 mm, linear with a width of 0.5 to 1.0 mm and a length of 5.0 to 20 mm, or shaped as a filled-in or hollowed-out cylinder with a diameter of 1.0 to 20 mm.

3. The industrial X-ray tube according to claim 1, having a heater that heats said cathode to 1000° C. or above.

4. The industrial X-ray tube according to claim 3, in which said heater is configured to pass an electrical current through the cathode to heat the cathode.

5. The industrial X-ray tube according to claim 1, having voltage control means that controls a voltage applied between said cathode and said anode wherein the voltage control means records the voltage-current characteristics between said cathode and said anode, and applies a voltage between said cathode and said anode according to the voltage-current characteristics.

6. The industrial X-ray tube according to claim 2, having a heater that heats said cathode to 1000° C. or above.

7. The industrial X-ray tube according to claim 6, in which said heater is configured to pass an electrical current through the cathode to heat the cathode.

8. The industrial X-ray tube according to claim 7, having voltage control means that controls a voltage applied between said cathode and said anode; wherein the voltage control means records the voltage-current characteristics between said cathode and said anode, and applies a voltage between said cathode and said anode according to the voltage-current characteristics.

* * * * *